United States Patent [19]

Nishikawa et al.

[11] Patent Number: 4,543,768

[45] Date of Patent: Oct. 1, 1985

[54] AUTOMATIC METHOD AND APPARATUS FOR PACKING STOCKINGS OR THE LIKE

[75] Inventors: Masao Nishikawa, Nara; Takahiro Ashida, Kashihara, both of Japan

[73] Assignee: Takatori Machinery Works Ltd., Japan

[21] Appl. No.: 383,152

[22] Filed: May 28, 1982

[30] Foreign Application Priority Data

May 30, 1981 [JP] Japan ..... 56-83036
Sep. 24, 1981 [JP] Japan ..... 56-151876

[51] Int. Cl.[4] ..... B65B 63/04

[52] U.S. Cl. ..... 53/117; 53/570; 53/571; 53/260

[58] Field of Search ..... 53/117, 429, 459, 469, 53/570, 114, 258, 260, 517, 571, 572; 493/23, 25, 443, 444, 445, 937

[56] References Cited

U.S. PATENT DOCUMENTS 907,122 12/1908 Bray ..... 493/445 X
3,768,226 10/1973 Glaze, Jr. ..... 53/117 X
3,773,315 11/1973 Tsien ..... 493/443
3,905,593 9/1975 Behn ..... 493/937
4,379,384 4/1983 Nishikawa ..... 53/117 X

FOREIGN PATENT DOCUMENTS 1206702 9/1970 United Kingdom ..... 53/117

*Primary Examiner*—John Sipos
*Assistant Examiner*—Steven P. Weihrouch
*Attorney, Agent, or Firm*—Ostrolenk, Faber, Gerb & Soffen

[57] ABSTRACT

Fully automatic, swift and reliable packing of stockings or the like is carried out by combination of an upstream stockings folder assembly and a downstream stockings encloser assembly, the folder assembly folds each pair of stockings for required times each time by cooperation of a reciprocal inserter plate and a nip formed by a pair of circulating suffaces for catching the stockings, and the encloser assembly inserts the folded stockings into plastic unit envelopes, either separate or combined in a continuous band, by cooperation of an insertion guide provisionaly enterable into each unit envelope and an inserter plate for assigning the folded stockings from the insertion guide to the unit envelope.

9 Claims, 22 Drawing Figures

AUTOMATIC METHOD AND APPARATUS FOR PACKING STOCKINGS OR THE LIKE

BACKGROUND OF THE INVENTION

The present invention relates to automatic method and apparatus for packing long stockings or the like, and more particularly relates to improvement in a system for packing, in an automatic fashion, a pair of stockings or the like into a plastic film envelope without use of any cardboard insert.

Although the following description is focussed upon application of the present invention to packing of long stockings, it should be understood that the present invention is advantageously applied to packing of any elongated, substantially flat and easily foldable objects.

Packing of a pair of long stockings in general includes two major steps. In the first step, the stockings are folded into three or more superimposed layers along fold lines perpendicular to their longitudinal direction in order to assume a position suited for insertion into a plastic film envelope. Next, the stockings in the folded state are enclosed into the envelope via its open mouth and the mouth is closed by sealing the flap of the envelope.

In one typical conventional system for folding a pair of stockings, a cardboard insert is first placed on the center section of the stockings and the thigh and calf sections are folded about the cardboard insert one on the other. Next the folded stockings with the inside cardboard insert are wrapped with a cover paper and inserted into a plastic film envelope whose mouth is thereafter closed by sealing its flap. The cardboard insert is used in order to prevent formation of creases on the stockings due to movement of the stockings within the envelope after packing. The cover paper is used for protection and/or decoration purposes.

When such folding of stockings is to be carried out in an automatic fashion, use of those cardboard insert and cover paper necessitates use of an extremely complicated equipment and such a complicated construction cannot always assure rapid and reliable operation of the equipment. Further use of such a cardboard insert and cover paper increases production costs.

In order to enclose the stockings, the mouth of a plastic film envelope is first opened and a pair of folded stockings are inserted into the bag section of the envelope via the open mouth. After the stockings have been inserted, a bonding tape is attached to the flap which is then folded over the bag section for sealing. This process also includes complicated operations. In order to carry out this process in automatic fashion, many different types of automatic equipment have been proposed.

One typical example of such a proposal is the automatic stockings encloser disclosed in Japanese Patent Publication Sho. 50-22477. In the case of this prior art, a pair of upper and lower clampers are used to hold a pair of stockings folded about a cardboard insert and the clampers are moved, by means of a carrier member, towards an envelope placed in a prescribed enclosing station. In this stand-by position, the flap of the envelope is pressed against the bottom face of an operation table by means of a pressor, the upper sheet of its bag section lifted by means of a pneumatic suction nozzle in order to open its mouth, and the mouth is maintained open by operation of a pair of openers actable on the mouth of the envelope. Under this condition, the above-described clampers carrying the stockings enter the bag section of the envelope. Then a solenoid operated pressor presses the envelope downwards against the top face of the operation table and the clampers recede outwards from the envelope while leaving the stockings with the cardboard insert inside the bag section of the envelope. The envelope is discharged outside the equipment by delivery rollers and the flap is folded and sealed by fusion bonding.

In the case of this prior art equipment, the openers are required to act on the envelope in order to keep its mouth open every time an envelope is brought to the enclosing station by the carrier.

In operation, the pair of openers move sideways apart from each other and engage with both lateral ends of the mouth of the envelope in order to keep it open during the enclosing operation. With this construction, it is not feasible to return the openers to their initial position just after complete insertion of the stockings in order to prepare for the next cycle operation since presence of the inserted stockings in the bag section of the envelope hinders smooth movement of the openers.

To avoid this problem, the clampers at the insertion advances towards the delivery rollers in a direction perpendicular to the movement of the carrier and removes the envelope off the openers in engagement with its mouth. After the envelope is removed, the openers return to their initial position in order to prepare for the next cycle operation.

In the case of the above-described prior art equipment, individual envelopes are separately supplied to the enclosing station and, after complete insertion of stockings, separately discharged therefrom. Thus, individual envelopes containing stockings are separately subjected to display on market. When stockings of different sizes, colors or designs are displayed together each in such a separated state, it is often troublesome for buyers to locate ones that they wish to buy since envelopes of different stockings are mixed together in piles. In order to avoid this problem, envelopes of similar stockings should be collected together for display and different stockings should be displayed at different places. This grouped display system, however, requires a large floor space for sales, in particular at super-markets where sales usually span huge members of articles including stockings.

In order to eliminate these disadvantages, it has recently been proposed to combine a number of envelopes of similar stockings together in a side by side relationship to form a band of envelopes. More specifically, a number of envelopes of similar stockings are connected to each other along their sides via aligned pin holes formed at borders between adjacent envelopes so that individual envelopes can readily be separated from the band of envelopes by tearing the band along pin hole lines. A tab with a hook may be attached to one longitudinal end of a band of envelopes so that the band of envelopes can be hung on a diaplay bar. When such a band is employed, there is no danger of mixing of envelopes of different stockings and buyers can easily locate stockings that they wish to buy. By suspending such bands the space necessary for display of many stockings is reduced. In addition, handling of stockings during transportation and storage can be simplified greatly since stockings of similar type are collected together in a common band by envelopes. Length of the band of envelopes can readily be adjusted by producers, dealers and retailers depending on the condition of transportation, storage and display for sales. At markets, buyers can take as many envelopes as desired from the envelopes bands merely by tearing the band along any pin hole line.

In order to suffice this recent demand for the band type sales of stockings, it is now required for stockings producers to ship their product in the form of band of envelopes.

As has been described, in the case of the conventional automatic stockings encloser, individual envelopes in a separate state are intermittently supplied to the enclosing station and, after complete insertion of a pair of stockings, each envelope is discharged off the enclosing station in a direction normal to the line of supply of the envelopes in order to cause disengagement of the openers from the mouth of the envelope. This process of disengaging the opener is feasible since individual envelopes are processed through the enclosing station in a completely separated state. In order to enable band type shipment of stockings, stockings have to be supplied to and discharged from the enclosing station in the form of a band of envelopes. As a consequence, it is no longer feasible to move individual envelopes in a direction normal to the line of supply of the stockings for disengagement for the openers since they are united monolithically in a common band. This means that the conventional mouth opening system for envelopes can no longer be employed in the case of the band type shipment of stockings.

In addition to the foregoing, use of the conventional envelope mouth openers has a further disadvantage that engagement of the openers with lateral ends of the envelope mouth often causes breakage of the ends.

SUMMARY OF THE INVENTION

It is one object of the present invention to enable the accurate automatic folding of long stockings or the like without using a cardboard insert and/or cover paper with the result that production costs are reduced.

It is another object of the present invention to enable trouble-free enclosing of long stockings or the like into plastic film envelopes which are processed in the form of a common continuous band for the purposes of band type shipment and sales of stockings.

In accordance with one aspect of the present invention, a pair of stockings in a stretched state are placed on a pair of parallel main conveyers of a stocking folder assembly with their longitudinal direction substantially normal to the path of conveyer circulation and, as a pair of stockings come in position about the center of the stockings is pushed downwards into a gap between the main conveyors by a vertical inserter plate. The inserted center section of the stockings are caught by a pair of rotary nip rollers so that the stockings are advanced downwards in a folded state and the stockings issuing from the nip in the folded state is pushed horizontally in order to be placed on a horizontal transfer conveyor in a double-folded state by operation of a horizontal folder plate. The double-folder stockings are enclosed into an envelope by a stocking encloser assembly at an enclosing station to which envelopes in a separated state are intermittently supplied to one after another.

In accordance with the other aspect of the present invention, unit envelopes in a common continuous band are intermittently supplied one after another to an enclosing station by a conveyer and, the conveyer movement is stopped for a dwell period, and the flap of each unit envelope is provisionally held by a flap holder with its mouth being kept open. A pair of stockings already folded by a stocking folder assembly is taken over by an insertion guide of a stocking encloser assembly and assigned from the insertion guide into the unit envelope in the enclosing station by operation of a stocking shifter slidably coupled to the insertion guide. After complete insertion of the stockings, the unit envelope is provisionally held immovable for smooth dissociation of the guide and shifter from the envelope.

In accordance with a further aspect of the present invention, a pair of stockings in a stretched state are placed on a pair of parallel main conveyors of a stocking folder assembly with their longitudinal direction substantially normal to the path of conveyer circulation and, as a pair of stockings come in position, about the center of the stockings is pushed downwards into a gap between the main conveyers by a vertical inserter plate. The inserted center section of the stockings are caught by a pair of rotary nip rollers so that the stockings are advanced downwards in a folded state and the stockings issuing from the rotary nip rollers in the folded state is pushed horizontally in order to be placed on a horizontal transfer conveyer in a double folded state by operation of a horizontal folder plate. The double-folded stockings are then passed to an enclosing station to which unit envelopes in a common continues band are intermittently supplied one after another by a conveyer. During each dwell of conveyer circulation, the flap of each unit envelope is provisionally held by a flap holder with its mouth being kept open. The pair of stockings from the stocking folder assembly is taken over by an insertion guide of a stockings encloser assembly and assigned from the insertion guide into the unit envelope in the enclosing station by operation of a stocking shifter slidably coupled to the insertion guide.

After complete insertion of the stockings, the unit envelope is provisionally held immovable for smooth dissociation of the guide and shifter from the envelope.

DESCRIPTION OF THE PREFERRED EMBODIMENTS

Figure 1:
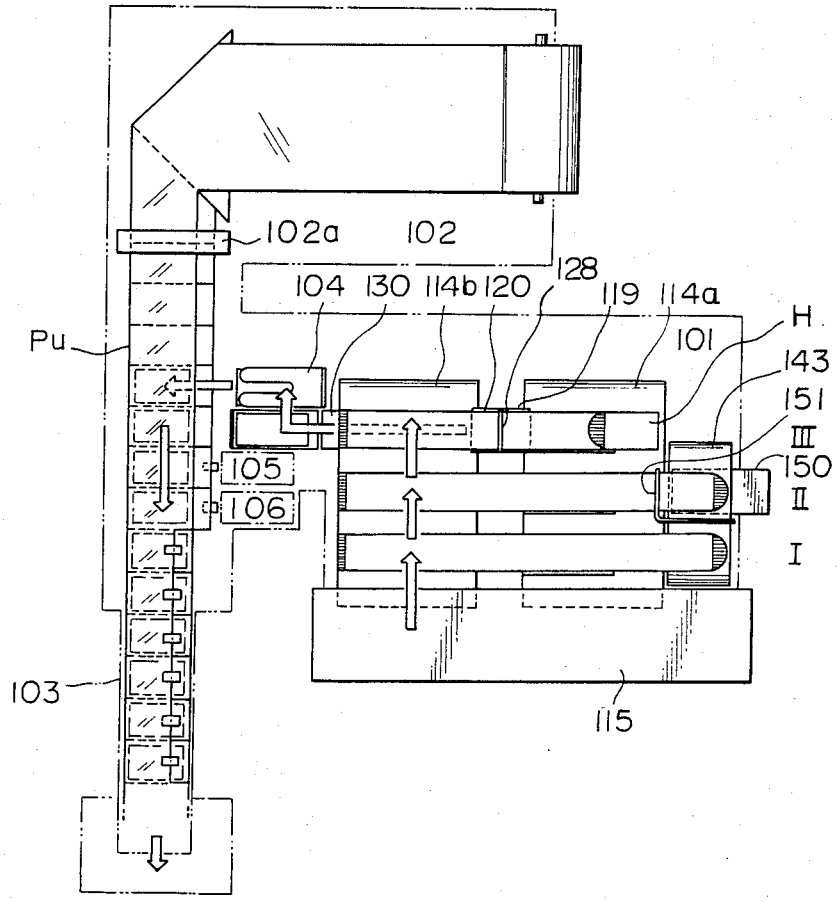
FIG. 1 is a plan view of one embodiment of the apparatus in accordance with the present invention in which plastic film envelopes in a separated state are intermittently supplied, one after another, to enclosing station.

A plan view of one embodiment of the automatic packing apparatus in accordance with the present invention is shown in FIG. 1, in which individual plastic film envelopes Pu are intermittently supplied, one after another, to an enclosing station.

The packing apparatus includes stocking, folder and encloser assemblies.

The stocking folder assembly shown in FIG. 1 includes a pair of parallel main conveyers 114*a* and 114*b* which intermittently circulate in a same direction in synchronism with one another. These conveyers 114*a* and 114*b* preferably take the form of endless belt conveyers driven which are circulated by a suitable drive mechanism (not shown).

In one modification of the present invention, however, the main conveyers 114*a* and 114*b* may be driven for continuous circulation without any dwell period. For simplification, the following description is mainly focussed upon the case of intermittent circulation.

A plurality of operation stations, for example operation stations I to III in the case of the illustrated embodiment, are arranged along the path of circulation of the main conveyers 114*a* and 114*b*, and an elongated gap G is formed between the downstream end sections of the main conveyers 114*a* and 114*b*, i.e. at the operation station III in the case of the illustrated embodiment. A vertical inserter plate 128 is arranged over the gap G while extending in the circulating direction of the main conveyers 114*a* and 114*b*. By periodical downward movement during each dwell of conveyer circulation, the inserter plate 128 pushes downwards about the center of a pair of stockings H carried by the main conveyers 114*a* and 114*b* so that the inserted center section of the stockings H should be caught by a pair of rotary nip rollers 119 and 120 arranged in the gap G below the conveyors 114*a*, 114*b*. At a position just below the nip rollers 119 and 120, there is located the upstream end section of a horizontal transfer conveyer 130 which, in the case of the illustrated embodiment, runs almost normal to the circulating direction of the main conveyers 114*a* and 114*b*.

By rotation of the nip rollers 119 and 120, the stocking H is advanced downwards in a single-folded state. Though not shown in FIG. 1, a horizontal folder plate 133 (FIG. 2) is arranged between the nip rollers 119, 120 and the upstream end section of the transfer conveyer 130. By periodical, horizontal reciprocation of the folder plate 133, the stockings H issuing from the nip rollers 119, 120 in the single-folded state are pushed horizontally and placed on the transfer conveyer 130 in a double-folded state. As the transfer conveyer 133 circulates, each successive stocking H in the double-folded state is moved off the stockings folder assembly 101 to the enclosing station near the downstream end of the transfer conveyer 130. The stocking H is then enclosed in an envelope Pu located at the enclosing station by operation of an encloser plate 104.

A sheet of plastic film band is delivered from a roll and folded along its longitudinal center line by an envelope shaper 102 and formed into individual envelopes Pu by a periodically operating a heat cutter 102*a*. The envelops Pu so prepared are supplied intermittently, one after another, by an envelope conveyer 103 running normal to the reciprocating direction of the enclosure plate 104.

Each envelope Pu is provided with a flap and, after a pair of stockings H have been inserted into the envelope Pu, a bonding tape is attached to the flap by a tape feeder 105 located downstream of the enclosing station. Next, the flap with the bonding tape is folded over the bag section by a sealing assembly 106 so that the envelope Pu containing the stockings H should be sealed.

As shown in FIG. 1, a sub-conveyer 143 is arranged on the outer side of and in parallel to one of the main conveyers, i.e. the main conveyer 114*a* in the case of the illustrated embodiment. An end folder assembly 147 (FIG. 2) is arranged at the operation station II and includes a folder plate 150 which is arranged below the sub-conveyer 143 and extensile over the main conveyer 114*a*. The end folder assembly further includes a folder rod 151 which is arranged over the main conveyer 114*a* and extends in the circulating direction of the main conveyer 114*a*. By operation of the end folder assembly 147, the end section of a pair of stockings H (FIG. 1) on the sub-conveyer 143 are folded over the intermediate section of the stockings H resting on the main conveyer 114*a*.

The stockings folder assembly 101 will now be explained in more detail in reference to FIGS. 2 through 4, in which a pair of carrier shafts 111*a* and 111*b* are horizontally mounted to the top section of a framework 110 of the apparatus, which are spaced from each other in and extend almost normal to the circulating direction of the main conveyers 114*a* and 114*b*. The shaft 111*a* carries a pair of conveyer rollers 112*a* and 112*b* and the other shaft 111*b* carries a pair of conveyer rollers 113*a* and 113*b*. The conveyer rollers 112*a* and 113*a* are used for circulation of the main conveyer 114*a* and the conveyer rollers 112*b* and 113*b* are used for circulation of the main conveyer 114*b*.

Figure 2:
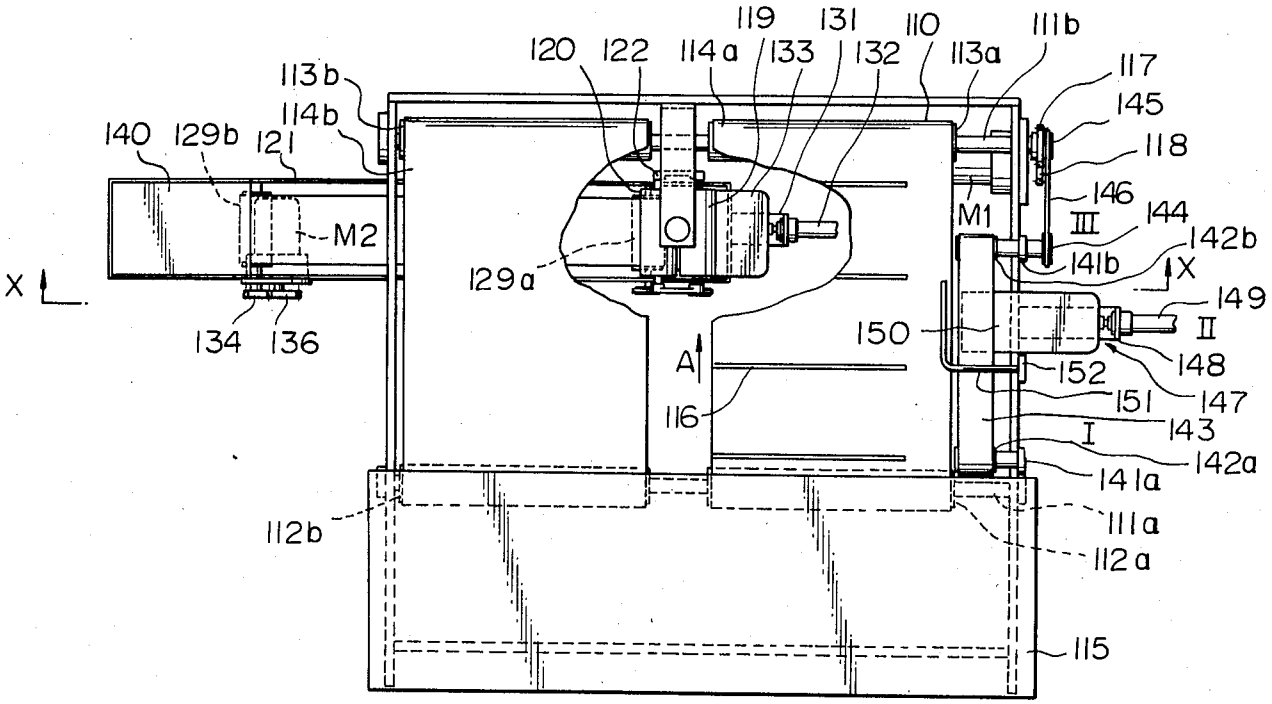
FIG. 2 is a plan view, partly removed, of a stocking folder assembly advantageously used for the apparatus shown in FIG. 1.
Figure 4:
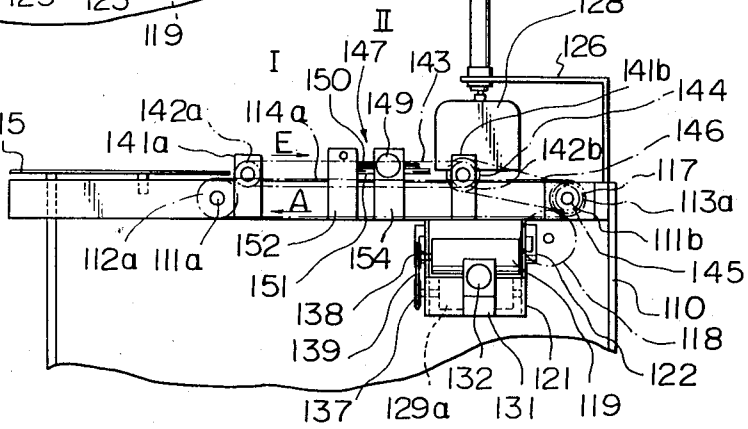
FIG. 4 is a side view of the stockings folder assembly shown in FIG. 2.

As best seen in FIGS. 2 and 4, an operation table 115 is mounted atop the framework 110 with its one end extending over the conveyer rollers 112*a* and 112*b* while facing the upstream ends of the main conveyers 114*a*, 114*b*. A plurality of transverse, elongated projections 116 are formed on the outer surface of the main conveyer 114*a* or 114*b* at equal intervals so that stockings H to be folded should be correctly supplied from the operation table 115 onto the main conveyer 114*a* or 114*b*. As a substitute for such projections, some suitable marks may be formed on the outer surface of the main conveyers for correct positioning of the stockings.

As already described, three operation stations I to III are arranged, from the upstream side where the operation table 115, along the path of circulation of the main conveyers 114*a* and 114*b*. Depending on the actual process condition, four or more operation stations may be arranged.

For drive of the main conveyers 114*a* and 114*b*, a driven gear 117 is secured to one end of the carrier shaft 111*b* which extends outside the frame-work 110, and a drive gear 118 in meshing engagement with the driven gear 117 is secured to the output shaft of a drive motor M1 mounted sideways to the frame-work 110. As the drive motor M rotates intermittently, the main conveyer 114*a* and 114*b* are both driven for intermittent circulation in the direction A in FIG. 2, each time over a pitch equal to the distance between adjacent operation stations.

At the operation station III, a pair of rotary nip rollers 119 and 120 are arranged below the top surfaces of and in the gap between the pair of main conveyers 114*a* and 114*b*. As shown in FIGS. 2 and 3, the one nip roller 119 is rotatably mounted at its both ends to an inner extension 121*a* of a channel 121 horizontally secured to the framework 110. Both ends of the other nip roller 120 are rotatably supported by the distal ends of swing arms 122. The proximal ends of the swing, arms 122 are pivoted to the inner end of the inner extension 121*a* of the channel 121 at a level higher than the pivots for the nip roller 119.

Figure 3:
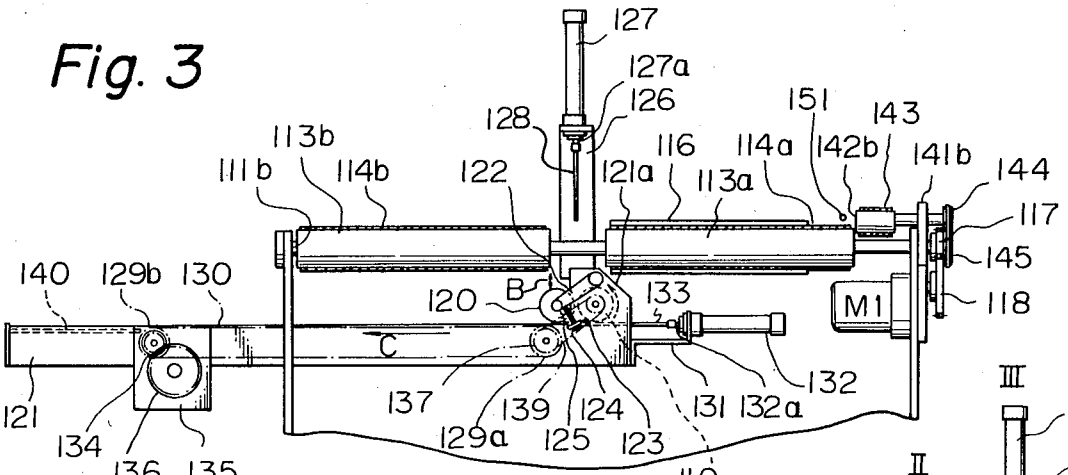
FIG. 3 is a partly omitted sectional view taken along a line X—X in FIG. 2.

As shown in FIG. 3, a stopper holder 123 is attached to one side of the channel extension 121*a* in screw engagement with a stopper bolt 124 whose point abuts the bottom face of one swing arm 122, and a spring 125 is interposed between the distal end of the swing arm 122 and the stopper holder 123 so that a small gap is left between the nip rollers 119 and 120. The nip roller 120 is reciprocal in the direction B in FIG. 3.

At the third operation station III, an inverted L-shaped stand 126 is mounted atop the framework 110 of the apparatus and its horizontal section carries a vertical pneumatic cylinder 127. The piston rod 127*a* of this pneumatic cylinder 127 is directed downwards and carries a vertical inserter plate 128 which extends downwardly in parallel to the circulating direction of the main conveyers 114*a* and 114*b*. At a position just below the inserter plate 128, a conveyer roller 129*a* is horizontally and rotatably carried by the channel extension 121*a* and an associated conveyer roller 129*b* is similarly carried by the channel 121 outside the framework 110. These conveyer roller 129*a* and 129*b* in combination carry a transfer conveyer 130 for horizontal circulation.

The arrangement is arranged so that, when the nip roller 120 assumes the position shown in FIG. 3, a small gap is left between the nip roller 120 and the upstream end of the transfer conveyer 130, and a horizontal pneumatic cylinder 132 is secured to the inner end of the channel extension 121*a* with its piston rod 132*a* being directed towards the above-described gap. A horizontal folder plate 133 is secured to the distal end of the piston rod 132*a*.

The above-described conveyer roller 129*b* is provided at its one end with a driven gear 134 as best seen in FIGS. 2 and 3, and a bracket 135 secured to the channel 121 supports a drive motor M2 whose output shaft carries a drive gear 136 in meshing engagement with the driven gear 134. As the drive motor M2 rotates, the transfer conveyer 130 is driven for circulation.

The conveyer roller 129*a* is provided at its one end with a pulley 137 which is operationally coupled to a pulley 138 attached to one end of the conveyer roller 129*b* by means of a transmission belt 139. As the drive motor M2 rotates, the nip roller 119 is driven for rotation in the direction D. As shown in FIG. 2, a flat receptacle 140 is mounted atop the channel 121 on the downstream extension of the transfer conveyer 130 with its top surface flush with that of the transfer conveyer 130.

A pair of bearing brackets 141*a* and 141*b* are arranged upright on the framework 110 on the outer side of the main conveyer 114*a* being adequately spaced in the circulating direction of the main conveyer 114*a*, and rotatably hold horizontal conveyer rollers 142*a* and 142*b*, respectively. The sub-conveyer 143 is carried by the conveyer rollers 142*a* and 142*b* for intermittent circulation synchronized with the circulation of the main conveyers 114*a* and 114*b*. As seen in the illustration, this sub-conveyer 143 roughly spans the distance between the first and second operation stations I and II. The level of the upper run of the sub-conveyer 143 is slightly higher than that of the main conveyer 114*a*. The conveyer roller 142*b* is provided at its one end with a pulley 144 which is operationally coupled, by means of a transmission belt 146, to a pulley 145 secured to one end of the carrier shaft 111*b*. As the drive motor M1 rotates, the sub-conveyer 143 is driven for circulation in the direction E in FIG. 4 in synchronism with circulation of the main conveyers 114*a* and 114*b*.

An end folder assembly 147 is arranged facing the sub-conveyer 143 in the second operation station II. That is, an L-shaped stand 148 is mounted atop the framework 110 in order to support a horizontal pneumatic cylinder 149 whose piston rod 149*a* is directed towards the main conveyer 114*a*. A horizontal folder plate 150 is secured to the distal end of the piston rod 149*a* in such an arrangement that the folder plate 150 is located below the upper run of the sub-conveyer 143 when the piston rod 149*a* receeds, but over the upper run of the main conveyer 114*a* when the piston rod 149*a* advances. The end folder assembly 147 further includes a folder rod 151 which is carried by an upright stand 152 secured atop the framework 110. This folder rod 151 has an L-shaped construction and extends in the circulating direction of the main conveyer 114*a* at a prescribed level.

With the above-described construction of the stockings folder assembly 101, the packing apparatus of the present invention operates as follows. As noted already, the description is focussed mainly upon the case in which the main conveyers 114*a* and 114*b* are driven for intermittent circulation and the envelopes Pu are intermittently supplied to the enclosing station.

Initially, a pair of stockings H in the stack on the operation table 115 are manually placed on the main conveyers 114*a* and 114*b* at the first operation station I. Stockings in general are classified into two types. In one type, the upper ends of stockings reach just below the knees of the wearer and such will hereinafter be referred to as short stockings. In the other type, the stockings extend upwards beyond the knees of the wearer and such will hereinafter be referred to as long stockings. In the case of short stockings, they are placed on both main conveyers 114*a* and 114*b* only. In the case of long stockings, their one end sections are also placed on the sub-conveyer 143.

Figure 5:
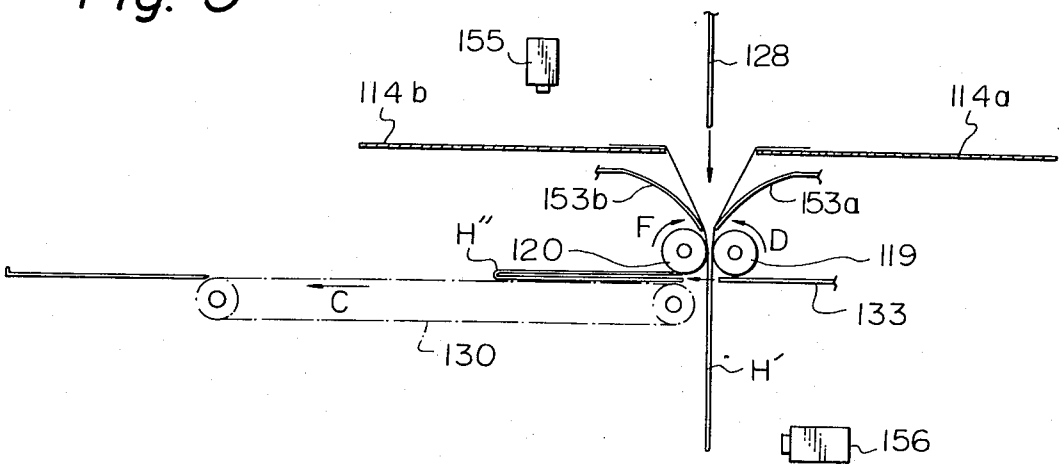
FIGS. 5 and 6 are simplified front views for illustrating the operation of the stocking folder assembly shown in FIG. 2.
Figure 6:
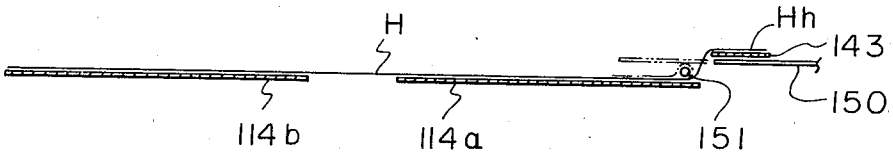

Operation of the stockings folder assembly 101 will be explained first in connection with processing of short stockings H mainly in reference to FIGS. 5 and 6.

The main conveyers 114*a* and 114*b* are driven for intermittent circulation by operation of the drive motor M1 in order to periodically supply pairs of stockings H to the third operation station III in FIG. 2. As a pair of stockings H come in position at the third operation station III, the arrival is detected by an overhead photoelectric sensor 155, and overhead pneumatic cylinder 127 operates, upon receipt of a signal from the sensor 155, to advance the inserter plate 128 downwards which thereupon pushes a line approximately at the center of the pair of stockings H down into the gap between the main conveyers 114*a* and 114*b*. The inserted center section of the pair of stockings H is then caught by the pair of nip rollers 119 and 120. At this moment, the nip roller 120 recedes, against tension by the spring 125, into the direction B in FIG. 3 due to the thickness of the pair of stockings H in order to allow passage of the pair of stockings H. Due to constant rotation of the nip roller 119 in the direction D, the stockings are further advanced downwards in a single-folded state as shown in FIG. 5. Due to the pressure contact with the nip roller 119 via the stockings, the nip roller 120 also rotates in the direction F. For smooth insertion of the stockings into the nip by the nip rollers 119 and 120, a pair of downwardly converging guides 153*a* and 153*b* may be arranged between the upper runs of the main conveyers 114*a* and 114*b* and the nip rollers 119 and 120 whilst leaving a bottom opening just above the nip by the nip rollers 119 and 120.

A photoelectric sensor 156 is arranged at a prescribed position below the level of the transfer conveyer 130 in order to detect the pair of stockings H′ issuing from the nip rollers 119 and 120 in the single-folded state. Upon detection, the photoelectric sensor 156 generates a signal to activate the pneumatic cylinder 132 which thereupon advances the folder plate 133 towards the pair of stockings H′ which are in the single folded state. By this advance of the folder plate 133, the stockings are inserted into the gap between the upper run of the transfer conveyer 130 and the nip roller 120. Next, pair of the stockings H″ in a double-folded state are transported in the direction C by circulation of the transfer conveyer 130.

The vertical position of the photoelectric sensor 155 is chosen so that the advancing folder plate 133 touches about the center of the pair of stockings H′ which are in the single-folded state.

The size of the gap between the nip roller 120 and the transfer conveyer 130 is preferably chosen to be twice as large as the thickness of the pair of stockings H′ issuing from the nip rollers 119 and 120 in the single-folded state so that proper pressure should act on the stockings caught in the gap, thereby avoiding development of creases on the pair of stockings H″ in the double-folded state.

After the pair of stockings H″ in the double-folded state has left the gap, the nip roller 120 resumes the original position due to tension of the spring 125 in order to apply, in cooperation with the nip roller 119, proper pressure to the next stockings inserted into the gap between the nip rollers 119 and 120.

The double-folded pair of stockings H″ are finally brought to the receptable plate 140 in the enclosing station and passed over to the stockings enclosing assembly.

Figure 7:
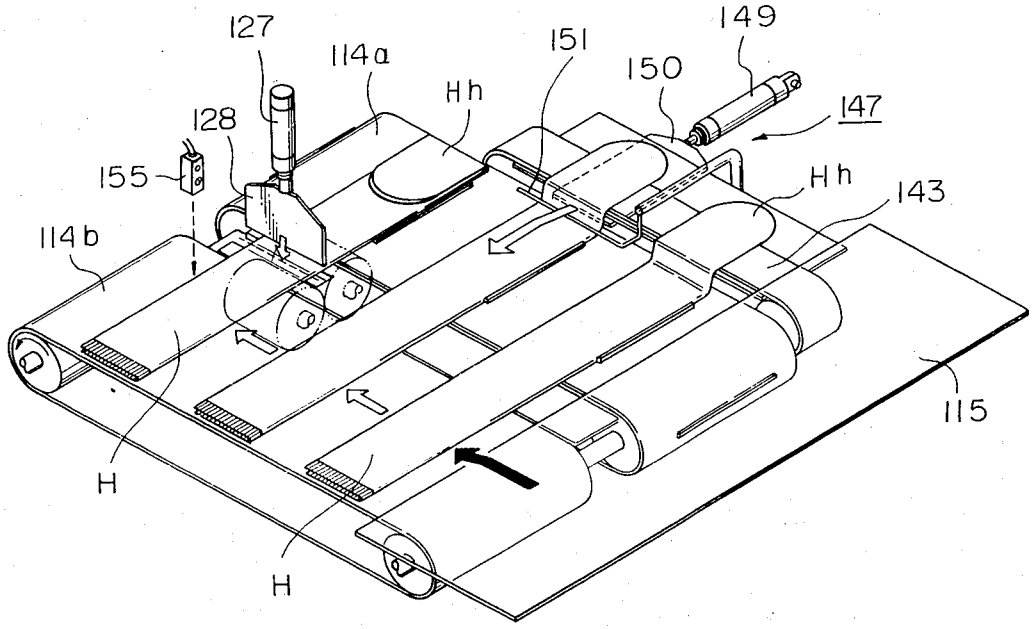
FIG. 7 is a perspective view for illustrating the operation of the stocking folder assembly shown in FIG. 2 which assembly is used for processing long stockings.

Next, operation of the stockings folder assembly 101 will be explained in connection with processing of long stockings, which will be best understood in reference to FIGS. 6 and 7. In this case, a pair of stockings H are taken from the stack on the operation table 115 and manually placed on the main conveyers 114*a* and 114*b* with their one end sections Hh placed on the sub-conveyer 143 which is driven for circulation in synchronism with the main conveyers 114*a* and 114*b*. As the pair of stockings H advance towards the third operation station III, i.e. the folding station, the section of the pair of stockings H close to the sub-conveyer 143 intrudes under the folder rod 151 of the end folder assembly 147. Before the pair of stockings H arrive at the folding station, the pneumatic cylinder 149 operates to advance the folder plate 150 towards the main conveyer 114*a* along a horizontal path just above the folder rod 151 as shown with chain lines in FIG. 6.

With further advance, the free end of the folder plate 150 touches the pair of stockings H and folds the end section Hh back over the remainder of the stockings H along a line defined by the folder rod 151.

By further circulation of the main conveyers 114*a* and 114*b*, the partly-folded pair of stockings H is released from engagement with the folder rod 151 and arrive at the folding station. This arrival is detected by the photoelectric sensor 155 in order to initiate the operation of the inserter plate 128. Further operation of the stocking folder assembly 101 is substantially same as that for the above-described short stockings.

For a simplified construction, the pneumatic cylinder 149 for the folder plate 150 may be electrically and operationally connected to the photoelectric sensor 155 so that its operation can be timed to that of the pneumatic cylinder 127 for the inserter plate 128.

In addition to the above-described short and long stockings, there is also a demand in market for extraordinarily long stockings by long-legged users. For economy in production, it is desirable that one size of envelopes can span stockings of wide variety of sizes including such extraordinarily long stockings. In order to successfully pack such extraordinary long stockings in envelopes of a common size, it is necessary to fold stockings more than two times.

Figure 8:
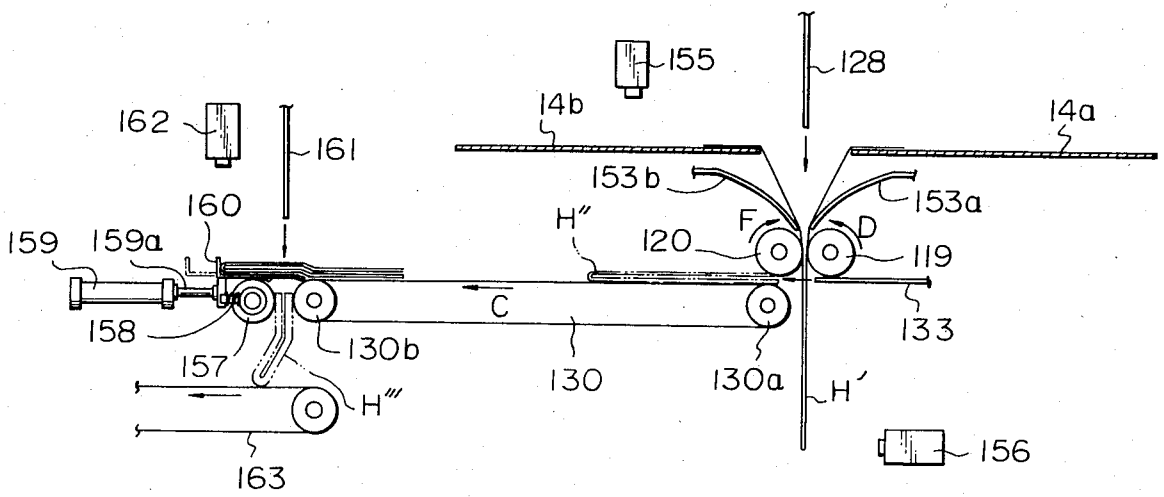
FIG. 8 is a simplified front view of a different embodiment of the stockings folder assembly adapted for processing extraordinarily long stockings.

One embodiment of the stocking folder assembly meeting this requirement is illustrated in FIG. 8, in which a pair of stockings are supplied to the enclosing station in a triple-folded state. Like the foregoing embodiment, the stocking folder assembly includes an inserter plate 128, a pair of nip rollers 119 and 120, a folder plate 133, a sensor 156 and a transfer conveyer 130. The transfer conveyer 130 is driven for circulation while being supported by a pair of conveyer rollers 130*a* and 130*b*.

The stockings folder assembly further includes a nip roller 157 arranged next to the downstream conveyer roller 130*b*. More specifically, the shaft of the nip roller 157 is received on both ends in horizontal slots (not shown) formed in the framework 110 of the apparatus, and the nip roller 157 is kept in elastic pressure contact with the downstream conveyer roller 130*b* by a compression spring 158 acting at one end on its shaft. The other end of the spring 158 is received in an appropriate seat (not shown) formed in or arranged on the framework 110. A pneumatic cylider 159 is horizontally arranged with its piston rod 159*b* being directed towards the nip roller 157. The piston rod 159*a* holds a horizontal supporter plate 160 at a level slightly above both the nip roller 157 and the upper run of the transfer conveyer 130. Usually the pneumatic cylinder 159 advances its piston rod 159*a* in order to keep the supporter plate 160 just over the nip by the pair of rollers 157 and 130*b*. A second vertical inserter plate 161 is arranged above the nip between the rollers 130*b* and 157, and driven for downward movement by operation of a proper pneumatic cylinder (not shown). A photoelectric sensor 162 is arranged above the nip roller 157, and operationally connected to the pneumatic cylinders for the second inserter plate 161 and for the supported plate 160. A second transfer conveyer 163 is horizontally arranged below the rollers 157 and 130*b* while extending towards the enclosing station.

As in the foregoing embodiment, a pair of stockings is first folded by operation of the first inserter plate 128 and the nip rollers 119 and 120, the single-folded pair of stockings H′ is again folded by operation of the folder plate 133 and the rollers 120 and 130*a*, and the double-folded pair off stockings H″ are further transported downstream by circulation of the first transfer conveyer 130.

Arrival of the double-folded pair of stockings H″ at the position of the supporter plate 160 is detected by the photoelectric sensor 162 which thereupon generates a signal to be passed to the pneumatic cylinders for the supporter and inserter plates 160 and 161. Receiving this signal, the pneumatic cylinder 159 operates to withdraw the supporter plate 160 from the position above the nip by the rollers 157 and 130*b*. Concurrently, the pneumatic cylinder for the inserter plate 161 operates so that the inserter plate 161 moves downwards in order to insert approximately the center of the double-folded stockings H″ into the nip by the rollers 157 and 130*b*. The elastic force on the nip roller 157 allows smooth insertion of the double-folded stockings H″ into the nip. By rotation of the rollers 157 and 130*b*, triple-folded stockings H″ are continuously issued from the nip onto the second transfer conveyer 163 for transportation towards the enclosing station.

Figure 9A:
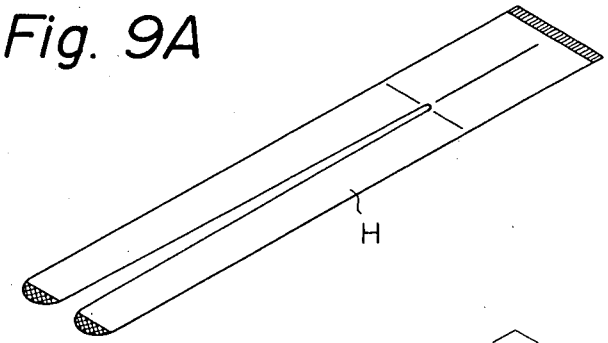
FIGS. 9A to 9E are perspective views showing how a pair of extraordinarily long stockings are processed on the folder assembly shown in FIG. 8.
Figure 9B:
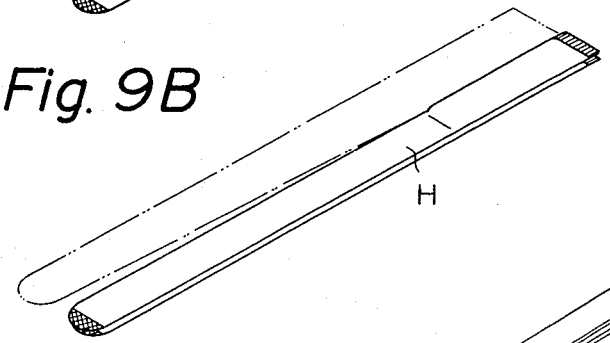

The total folding operation wherein a pair of stockings is folded from its from the first manual setting to the final triple-folded state is best seen in FIGS. 9A to 9B.

Figure 9C:
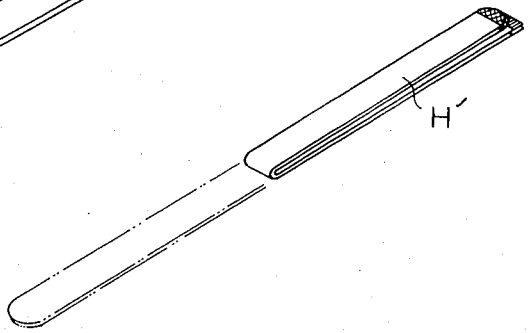
Figure 9D:
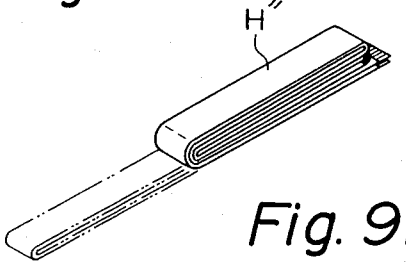
Figure 9E:
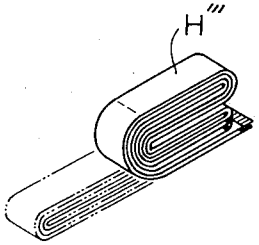

A pair of stockings H (panty hose in the illustrated embodiment) are placed in the stack on the operation table 115 as shown in FIG. 9A, folded together along the center line of the crotch into a superimposed state shown in FIG. 9B, and manually placed on the main conveyers 114*a* and 114*b*. FIG. 9C illustrates single-folded state of the pair of stockings H′ formed by operation of the first inserter plate 128 and the nip rollers 119 and 120. They are next reformed into a double-folded state is shown at H″ in FIG. 9D by operation of the folder plate 133 and the rollers 120 and 130*a*. Finally, the triple-folded state of the pair of stockings H″ shown in FIG. 9E and suited for enclosure in a common size envelope Pu is obtained by operation of the second inserter plate 161 and the rollers 157 and 130*b*.

Figure 10:
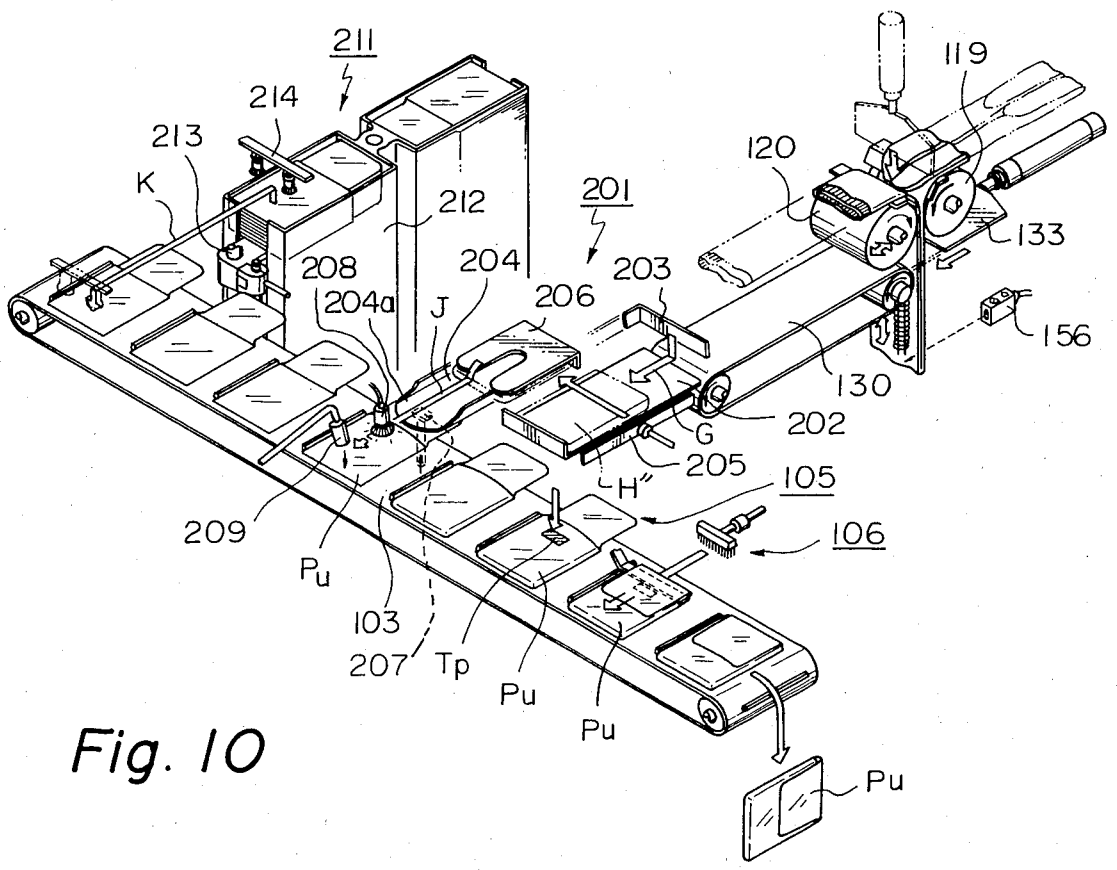
FIG. 10 is a perspective view of a different embodiment of the stockings encloser assembly advantageously used for the apparatus shown in FIG. 1 and in particular suited for a system in which envelopes in a separated state are supplied to the enclosing station.

One embodiment of the stockings encloser assembly is shown in detail in FIG. 10, in which envelopes Pu in a separated state are intermittently supplied to the enclosing station one after another, and double-folded pairs of stockings H″ are packed in respective envelopes Pu in sequence.

The stockings encloser assembly 201 includes a support tray 202 arranged next to the downstream terminal of the transfer conveyer 130 and a cam driven transfer plate 203 which reciprocates as shown by arrow G in order to transfer the double-folded pair of stockings H″ from the transfer conveyer 130 onto the support tray 202. A guide tray 204 is arranged on one side of the support tray 202 with its tongue 204*a* extending over the flaps of the envelopes Pu carried by the envelope conveyer 103. On the other side of the support tray 202 is arranged a transfer plate 205 which is reciprocal over the distance between both trays 202 and 204 in order to transfer the stockings H″ from the support to guide tray. The transfer plate 205 may be pneumatically driven for the reciprocation in any known manner. An encloser plate 206 is arranged in combination with the guide tray 204 and is able to advance, as shown by arrow J, towards the envelope Pu in the enclosing station. A pneumatically driven pressor 207 is arranged below the tongue 204*a* of the guide tray 204 in order to press the flap of the envelope Pu in the enclosing station against the bottom of the tongue 204*a* of the guide tray 204. A pneumatic suction mouth 208 is arranged slightly above the enclosing section in order to open the bag section of the envelope Pu in the enclosing station. A pressor 209 is arranged on the opposite side of the envelope conveyer 103 in order to provisionally hold, by its vertical swing motion, the closed bottom of the envelope Pu during enclosing of the double-folded pair of stockings H″.

Every time a double-folded pair of stockings H″ arrives at the downstream terminal of the transfer conveyer 130, the first transfer plate 203 starts to move as shown by the arrow G and passes the pair of stockings H″ onto the transfer plate 205. Thereupon the second transfer plate 205 moves the pair of stockings H″ towards the encloser plate 206. Concurrently with this process, an empty envelope Pu is brought to the enclosing station with its flap being inserted below the tongue 204*a* of the guide tray 204, the first pressor 207 lifts to press the flap of the empty envelope Pu against the bottom face of the tongue 204*a* of the guide tray 204, the second pressor 209 swings downwards in order to hold firm the empty envelope at the enclosing station, and the suction mouth 208 operates to open the bag section of the envelope Pu, the encloser plate 206 carrying the double-folded pair of stockings H″ advances along the guide tray 204 in order to insert the pair of stockings H″ into the open bag section of the envelope Pu, the encloser plate 206 recedes to its initial stand-by position after complete insertion of the double-folded stockings H″ into the envelope Pu in the enclosing station, the suction mouth 208 ceases its operation and the first and second pressors 207 and 209 both recede to their initial stand-by positions in order to release the envelope Pu now containing the double-folded stockings H″. These operations are all carried out during a dwell period of the envelope conveyer 103. After the enclosing operation has been completed, the envelope conveyer 103 starts its next circulation. A bonding tape Tp is attached to the top face of the bag section of the envelope Pu by operation of the tape feeder 105, the flap is next folded over the bag section by operation of the sealing assembly 106 (see FIG. 1) in order to seal the mouth of the envelope Pu containing the pair of stockings H″, and the envelope Pu containing the pair of stockings H″ is discharged off the system by further intermittent circulation of the envelope conveyer 103.

The empty envelopes Pu are supplied to the system by operation of an envelope feeder assembly 211. The envelope feeder assembly 211 is arranged on the upstream side of the encloser assembly 201 while facing the envelope conveyer 103. The feeder assembly 211 includes a vertical hopper 212 in which a stack of envelopes Pu are reserved. More specifically, a lifter 213 is arranged within the hopper 212 and supports the stack of envelopes Pu. The lifter 213 function to lift intermittently every time the uppermost envelope Pu in the stack is taken away so that the top face of the stack is always kept at a level almost flush with the top edge of the hopper 212. A pair of pneumatic suction mouths 214 is arranged slightly above the top opening of the hopper 212 and moves as shown by an arrow k in order to take the uppermost envelope Pu from the stack in the hopper 212 and pass it onto the envelope conveyer 103.

Figure 11:
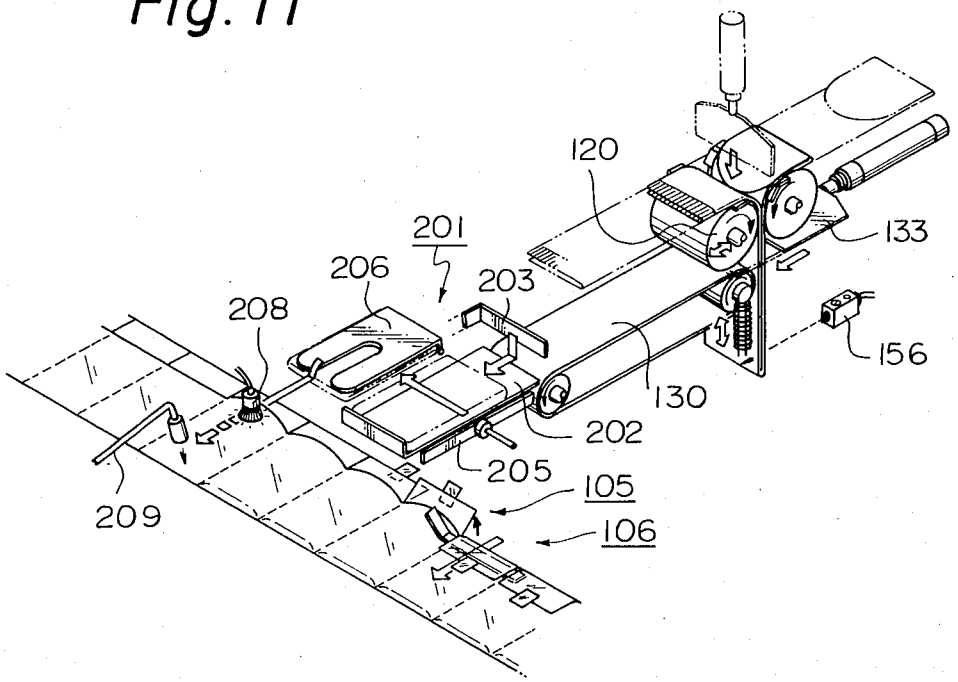
FIG. 11 is a perspective view of a further embodiment of the stockings encloser assembly advantageously used for the apparatus shown in FIG. 1, and in particular suited for a system in which unit envelopes in a common continuous band are supplied to the enclosing station.

Another embodiment of the stockings encloser assembly is shown in detail in FIG. 11, in which unit envelopes Pu' in a common continuous band are intermittently supplied one after another to the enclosing station by intermittent circulation of the envelope conveyer 103 (not shown). In this case, the construction of the stockings encloser assembly 201 is basically the same as that shown in FIG. 10 with the exception that the guide tray 206 and the first pressor 207 are omitted for smooth movement of the continuous band.

Another embodiment of the stockings encloser assembly in accordance with the present invention is shown in detail in FIGS. 12 through 15, in which unit envelopes in a common continuous band are intermittently supplied one after another to the enclosing station located next to the downstream terminal of the transfer conveyer for double-folded or triple-folded pair of stockings.

Figure 14:
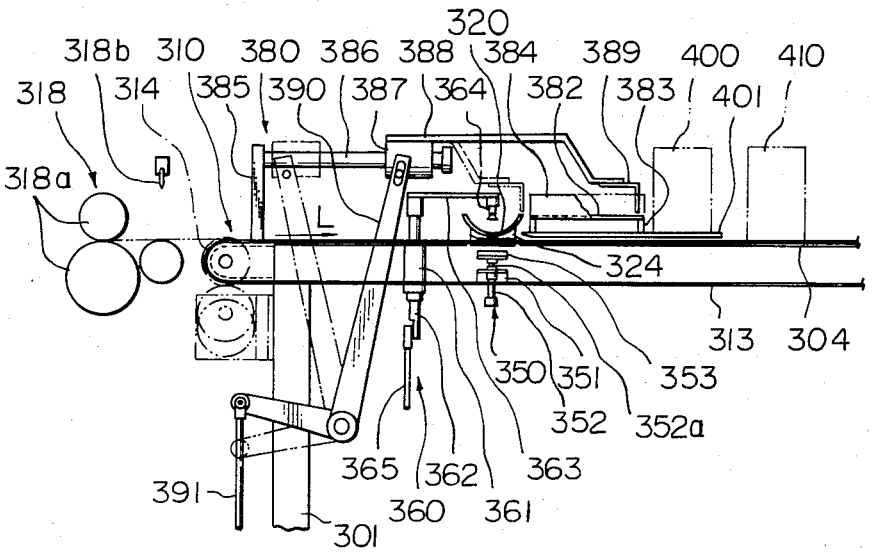
FIG. 14 is a sectional view taken along a line Z—Z in FIG. 12.

An envelope conveyor 310 in this embodiment includes a pair of conveyor rollers 312 (one of which is omitted in the drawings) horizontally mounted to a pedestal 301 by brackets 311, and a conveyers belt 313 horizontally carried by the conveyer rollers 312 for intermittent circulation in the direction L in FIG. 14. To this end, the shaft 312*a* of the one conveyer roller 312 securedly carries a gear 314 which is in meshing engagement with another gear 317 secured to the output shaft 316*a* of the drive motor 316. The drive motor 316 rotates intermittently in accordance with an appropriate program.

The envelope conveyer 310 is adapted for transporting a band of envelopes BP from an upstream envelope feeder 318 to the enclosing station. The envelope feeder 318 includes a pair of cooperating feed rollers 318*a* which delivers a plastic film sheet in a double folded state towards the envelope conveyer 310, and an envelope shaping plate 318*b* which forms unit envelopes P on the band of envelopes BP by thermal fusion.

Figure 12:
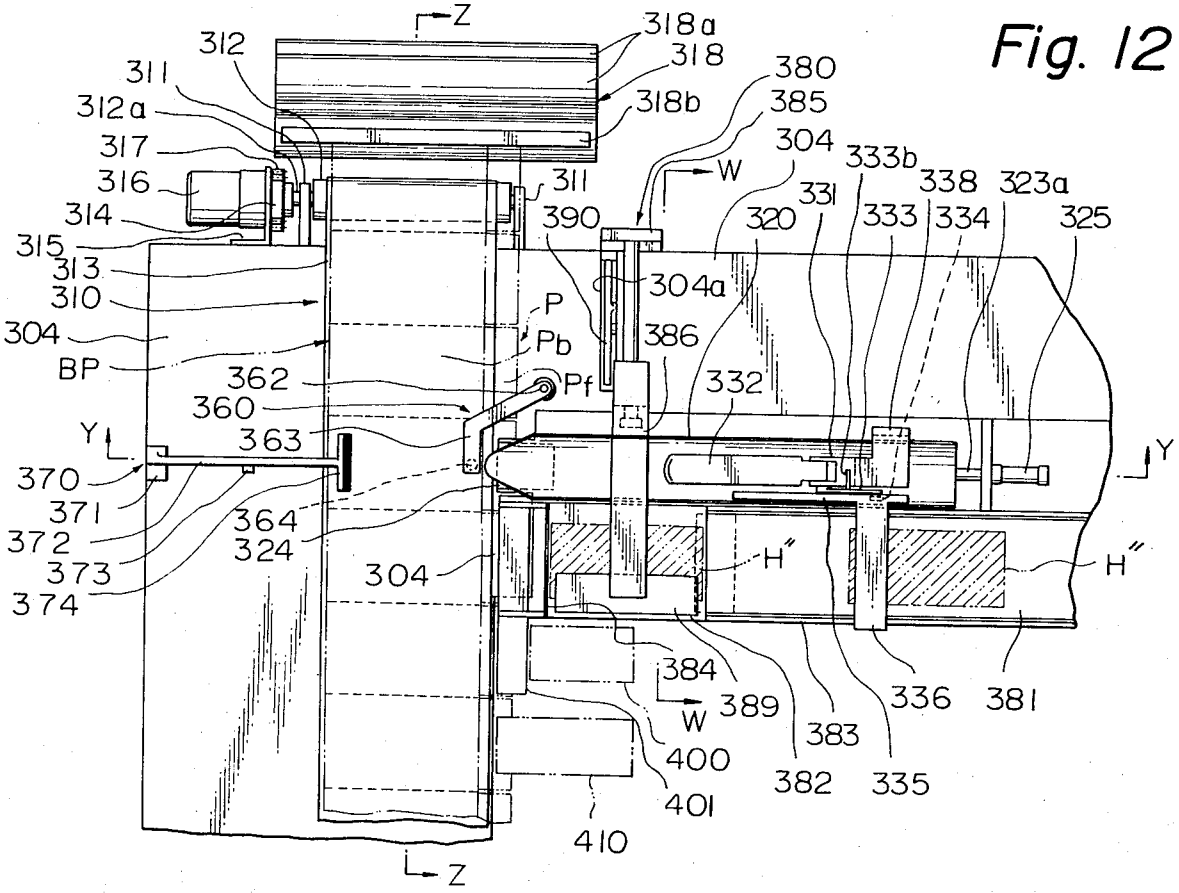
FIG. 12 is a plan view of a further embodiment of the stockings encloser assembly advantageously used for the apparatus shown in FIG. 1.

As best seen in FIG. 12, the band of envelopes BP includes a number of unit envelopes P connected side by side to each other, and each unit envelope P includes a bag section Pb and a flap Pf which closes the open mouth of the bag section Pb when folded. The band of envelopes BP is placed on the envelope conveyor 310 so that the open mouth of the bag section Pb and the flap Pf of each unit envelope P are directed towards the transfer conveyer for folded stockings.

An insertion guide 320 is arranged facing the enclosing station while extending in a direction normal to the path of circulation of the envelope conveyer 310. The insertion guide 320 functions to keep the unit envelopes P arriving at the enclosing station in the open state and to guide the stockings towards the open bag section Pb of each unit envelope P.

Figure 13:
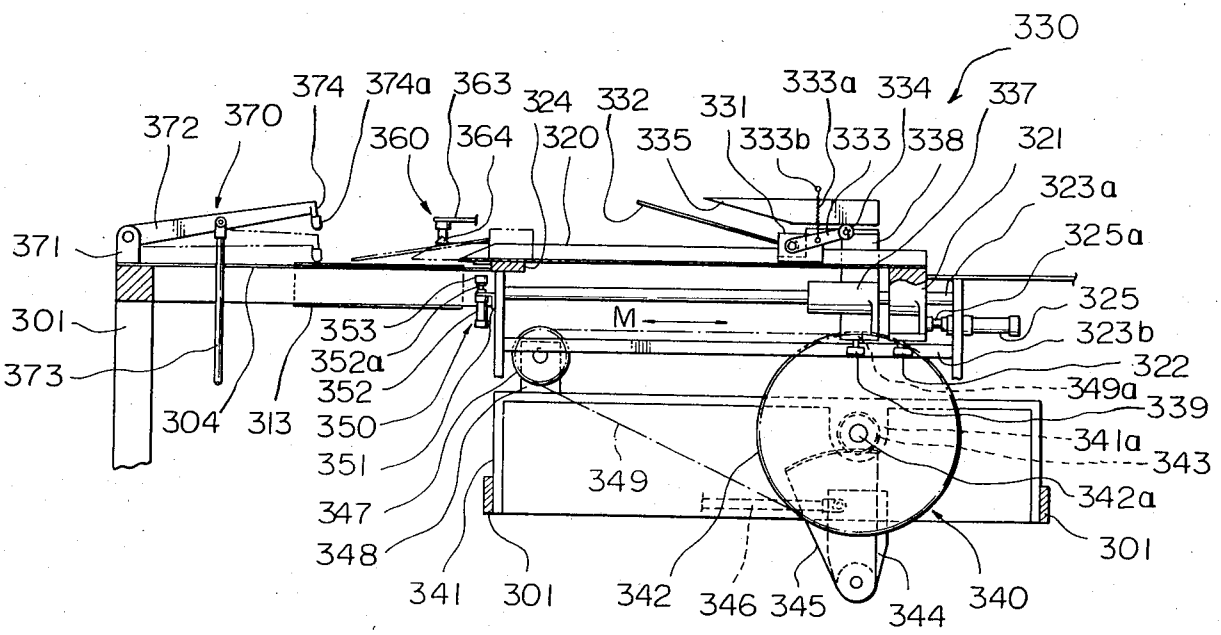
FIG. 13 is a sectional view taken along a line Y—Y in FIG. 12.

More specifically, the insertion guide 320 has a shape of an elongated tray and its front end is converged for easy and smooth insertion of the stockings operated. Though an insertion guide 320 with a crescent cross sectional profile is exemplified in the drawings, the insertion guide 320 may have other cross sectional profiles as long as it assures the above-described easy and smooth insertion of the stockings into the unit envelopes. As best seen in FIG. 13, a downwardly extending slider 321 is secured to the rear end of the insertion guide 320. On both sides of its bottom face, the slider 321 is provided with a pair of guide rollers 322 having vertical axis. Upper and lower guide rails 323*a* and 323*b* are horizontally mounted to the pedestal 301 below the insertion guide 320 while extending in a direction normal to the path of travel of the envelope conveyer 310. The upper guide rail 323*a* extends idly through the abovedescribed slider 321 in order to keep the horizontal posture of the insertion guide 320. Whereas, the lower guide rail is in rolling contact with the above-described guide rollers 322 in order to assure stable reciprocation of the insertion guide 320 during the operation.

Figure 15:
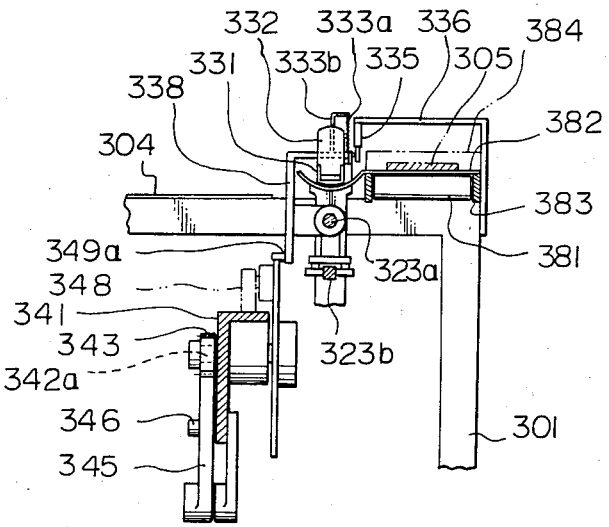
FIG. 15 is a sectional view taken along a line W—W in FIG. 12.

In FIGS. 14 and 15, the insertion guide 320 rests at its stand-by position as shown with solid lines. In this position, the insertion guide 320 is accompanied with a support plate 324 which is secured to the pedestal 301 below the front end of the insertion guide 320 and adapted for sliding contact with the insertion guide 320 when the latter reciprocates. The upper section of this support plate 324 facing the envelope feeder 318 is cut off for smooth introduction of the flap Pf of each unit envelope P moving into the enclosing station. As shown in FIG. 13, a pneumatic cylinder 325 is horizontally mounted to the pedestal 301 and its piston rod 325*a* is coupled to the back of the slider 321. As the pneumatic cylinder 325 operates, the insertion guide 320 reciprocates between the stand-by position shown with solid lines and the operating position shown with chain lines as indicated by an arrow M in FIG. 13.

An inserter assembly 330 is arranged on the insertion guide 320 and transfers the folded stockings along the insertion guide 320 towards a unit envelope P standing by at the enclosing station. As shown in FIGS. 12, 13 and 15, the inserter assembly 330 includes slider 331 arranged on the insertion guide 320 and having a convex bottom corresponding to the concave top of the insertion guide 320. An inserter plate 332 is attached to the front of the slider 331. The proximal end of this inserter plate 332 is pivotally connected to the slider 331 by means of a horizontal shaft which is coupled at one end to the lower end of an arm 333. The top end of this arm 333 rotatably carries a cam follower 334. Just above the rear end section of the insertion guide 320 resting at the stand-by position, a plate cam 335 is horizontally carried by a bracket 336 mounted atop the pedestal 301. A rod 333*b* is mounted atop the slider 331 and a tension spring 333*a* is interposed between the top end of the rod 333*b* and the arm 33 in order to keep the cam follower 334 on the arm 333 in resilient pressure contact with the plate cam 335. Another slider 337 is idly inserted over the upper guide rail 323*a* on the front side of the first slider 321 and carries a bracket 338. This bracket 338 is made up of a vertical section facing one side of the insertion guide 320 and an overhead horizontal section which is secured at the front end to the upper back of the slider 331. A pair of guide rollers 339 are attached to the bottom of the slider 337 sandwiching the lower guide rail 323.

The drive mechanism 340 for the inserter assembly 330 is shown in detail in FIGS. 13 and 15, in which the drive mechanism 340 includes a base plate 341 horizontally mounted to the pedestal 301 below the lower guide rail 323, a sprocket 342 of a larger diameter carried by a bearing 341*a* formed on the base plate 341, and a gear 343 secured to the center shaft 342*a* of the sprocket 342. At a position below the above-described bearing 341*a*, a bracket 344 is secured to the base plate 341 and pivotally carries the proximal end of a sector gear 345 in meshing engagement with the gear 343. The distal end of a connecting rod 346 is pivoted to the body of the sector gear 345. This connecting rod 346 is driven for horizontal reciprocation by a proper drive source (not shown) operationally coupled thereto.

Another sprocket 347 of a smaller diameter is rotatably carried by a bracket 348 mounted to the base plate 341, and operationally coupled to the larger sprocket 343 by means of an endless chain 349. The endless chain 349 is coupled to the lower end of the bracket 338 of the inserter assembly 330.

As the connecting rod 346 advances in FIG. 13 the sector gear 345 swings rightwards about the pivot and, via the gear 343, the larger sprocket 342 is driven for counterclockwise rotation in order to cause counterclockwise circulation of the endless chain 349. Due to this circulation of the endless chain 349, the slider 337 travels along the insertion guide from the stand-by position shown with solid lines to the operating position shown with chain lines. Following this travel of the slider 337, the slider 331 carrying the inserter plate 332 and the cam follower 334 moves in the same direction. That is, the cam follower 334 rolls on the plate cam 335. As long as the cam follower 334 is kept in contact with the straight horizontal section of the plate cam 335, the front end of the inserter plate 332 is kept at a stand-by positions over the insertion guide 320. When the cam follower 334 starts to engage with the slope section of the plate cam 345, the inserter plate 332 gradually swings downwards and eventually assumes its lowest position shown with chain lines.

The enclosing station is further provided with a flap holder assembly 350 (FIG. 13) which firmly holds the flap Pf of every unit envelope P brought to the station by the intermittent circulation of the envelope conveyer 310, an opener assembly 360 which opens the bag section Pb of the unit envelope P, and a stockings holder assembly 370 which presses down the envelope containing the stockings for easy recession of the inserter assembly 330 after complete insertion of the stockings.

The flap holder assembly 350 is best shown in FIGS. 13 and 14. On one side of the envelope conveyer 310 closer to the insertion guide 320, a penumatic cylinder 352 is vertically mounted to the framework 301 by means of a bracket 351 with its piston rod 352*a* being directed upwards, and a pressor 353 made up of friction resistant rubber is secured atop the piston rod 352*a* in order to press the flap Pf of the unit envelope P against the bottom of the support plate 324 arranged beneath the insertion guide 320.

The opener assembly 360 for opening the bag section Pb of each unit envelope is best shown in FIGS. 12 and 14. Near the flap holder assembling 350, a bearing 361 is vertically mounted to the framework 301 in order to receive a vertical rod 362 which extends upwards beyond the horizontal table 304. The top end of this rod 362 carries a bent arm 363 which extends towards the mounth of the bag section Pb of each unit envelope P standing by in front of the insertion guide 320 and the inserter assembly 330. A suction mouth 364 connected to a given suction source (not shown) is arranged on the bottom of the distal end of this bent arm 363. As shown in FIG. 14, the lower end of the vertical rod 362 is operationally coupled to a given drive source (not shown) by means of a connecting rod 365.

As the connecting rod 365 moves vertically, the distal end of the bent arm 363 over the horizontal table 304 is driven for vertical reciprocation above the band of envelopes BP placed on the envelope conveyer 310.

The stockings holder assembly 370 is best shown in FIGS. 12 and 13. On the side of the envelope conveyer 310 remote from the insertion guide 320, a bracket 371 is mounted to the top face of the horizontal table 304 and pivotally supports the proximal end of a swing lever 372 which extends towards and over the envelope conveyer 310. This swing lever 372 is operationally coupled to a given drive source (not shown) by means of a connecting rod 373, and carries, at its distal end, a holder plate 374 accompanied with a friction resistant rubber 374*a*.

As the connecting rod 373 moves vertically, the holder plate 374 is driven for vertical reciprocation above the bottom of the bag section Pb of the unit envelope P placed on the envelope conveyer 310.

The enclosing station is further equipped with a stockings transfer assembly 380 which feeds a pair of stockings in position on the insertion guide 320.

In FIGS. 12 and 14, the transfer assembly 380 includes a transfer plate 382 is horizontally supported by a conveyer framework 383 at a position close to the downstream terminal of a transfer conveyer 381 which transfers the folded stockings H".

The top face of the transfer plate 382 is flush with the upper run of the transfer conveyer 381 and with the side edge of the insertion guide 320. On the side facing the envelope conveyer 310, the transfer plate 382 is provided with an upright guide plate 384 for the folded stockings H" carried by the transfer conveyer 381.

On the side of the insertion guide 320 opposite to the transfer plate 382, an upright bracket 385 is mounted to the framework 301 and carries a horizontal guide rod 386 which extends towards the insertion guide 320 over the horizontal table 304. A slider 387 is idly inserted over the guide rod 386 and carries a support plate 388 which extends over the above-described transfer plate 382 located on the opposite side of the insertion guide 320. A downwardly angled feeder plate 389 is secured to the distal end of the support plate 388. A bifurcated lever 390 is pivoted at its apex to the framework 301 and its top end is pivoted to one side of the slider 387 on the guide rode 386. The lower end of the lever 390 is operationally coupled to a given driven source (not shown) by means of a connecting rod 391.

As the connecting rod 391 moves downwards from the position shown with solid lines in FIG. 14, the bifurcated lever 390 swings counterclockwise to the position shown with chain lines in FIG. 14 and the slider 387 with the support plate 388 and the feeder plate 389 moves to a position shown with chain lines in FIG. 14.

A tape feeder 400 is arranged on the downstream side of the enclosing station and is adapted to attach a bonding tape to the outer surface of the flap Pf of a unit envelope P containing a pair of folded stockings H". The tape feeder 400 includes a flat guide plate 401 adapted for guiding the flap Pf in cooperation with the horizontal table 304.

A sealing assembly 410 is arranged next to the tape feeder 400 in order to fold back the flap Pf with the bonding tape on the bag section Pf of the envelope P for sealing purposes.

With the above-described construction of the stockings encloser assembly, each pair of folded stockings brought to the enclosing station are packed into a corresponding unit envelope in the following sequence.

A pair of stockings H" already folder properly by operation of the stockings folder assembly are brought towards the transfer plate 382 by circulation of the transfer conveyer 381.

Figure 16A:
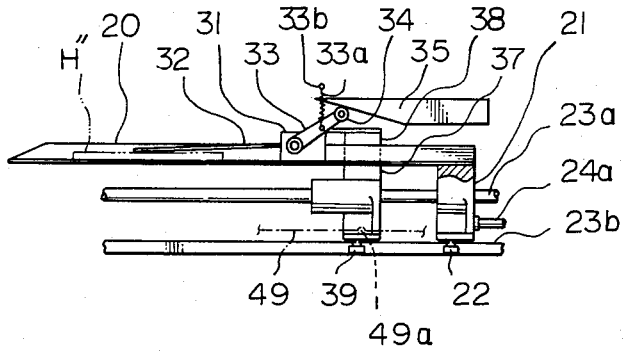
FIGS. 16A to 16C are side and perspective views showing the operation of the stocking encloser assembly shown in FIGS. 12 to 15.

As the folded pair of stockings H" so carried abuts the guide plate 384 on the transfer plate 382, the connecting rod 391 in FIG. 14 moves downwards and the lever 390 swings to the chain line position so that the feeder plate 389 is driven for displacement from the side edge position of the transfer plate 382 (solid lines) to the side edge position of the insertion guide 320 (chain lines). By this displacement of the feeder plate 389, the folded pair of stockings H" located on the transfer plate 382 moved to the insertion guide 320 with their one edge sliding along the guide plate 384, After the folded pair of stockings has been moved to guide 320, the stockings transfer assembly 380 resumes its initial position and, simultaneously, the pneumatic cylinder 325 coupled to the insertion guide 320 and the connecting rod 344 of the drive mechanism 340 start their operation so that the insertion guide 320 and the inserter plate 332 both advance towards the envelope conveyer 310. During this movement, the cam follower 334 comes in engagement with the slope of the plate cam 335 and, due to the operation of the spring 333*a*, the inserter plate 332 gradually swings downwards. As the cam follower 334 is released from contact with the plate cam 335, the inserter plate 332 assumes the position shown in FIG. 16A in which its distal end comes into pressure contact with approximately the center section of the folded pair of stockings H" on the insertion guide 320. In this pressed state, the folded stockings H" are moved towards the envelope conveyer 310 by further displacement of the inserter plate 332.

Figure 16B:
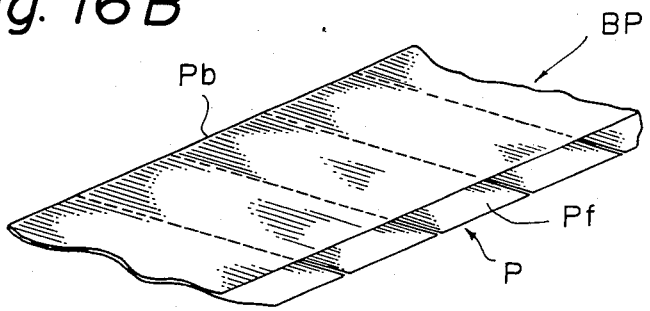

In synchronism with delivery of the band of envelopes BP by operation of the envelope feeder 318, the conveyer belt 313 is driven by intermittent circulation in the direction L in FIG. 14 by the drive motor 316. The band of envelopes BP is made up of a number of unit envelopes P with their bag sections Pb being connected side by side and flaps Pf being separated from each other as shown in FIG. 16B.

As shown in FIG. 12, the band of envelopes BP is placed on the envelope conveyer so that, in the enclosing station, the bag section Pb of each unit envelope P should rest on the conveyer belt 313 and the flap Pf should project from one side of the conveyer belt 313 over the horizontal table 304.

During each dwell period of the conveyer circulation, one unit envelope P in the band of envelopes BP is in registration with at the enclosing station facing the insertion guide 320. The flap Pf of the unit envelope P slides on the horizontal table 304 and stops at a position just below the support plate 324.

Thereupon, the connecting rod 365 (FIG. 14) of the opener assembly 360 moves downwards in order to lower the bent arm 363 over the horizontal table 304, and the suction mouth 364 on the distal bottom of the bent arm 363 engages the bag section Pb of the unit envelope P located facing the insertion guide 320.

Figure 16C:
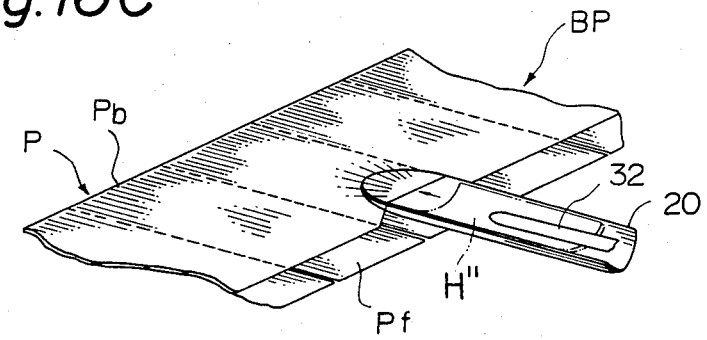

More specifically, the insertion guide 320 and the inserter plate 332 both advance at an almost equal speed until the insertion guide 320 arrives and remains at a standstill at the chain line position shown in FIG. 13. At this chain line position, the distal end of the insertion guide 320 enters the bag section Pb of the unit envelope P standing by in the open state as shown in FIG. 16C and maintains the open state of the bag section Pb formed by operation of the suction mouth 364 of the opener assembly 360. Thereupon the suction mouth 364 is deactivated in order to pass over the bag section Pb of the unit envelope P to the insertion guide 320.

After stoppage of the insertion guide 320 at the chain line position, the inserter plate 332 further advances along the insertion guide 320 in order to fully insert the pair of stockings H" in the bag section Pb of the unit envelope P. Next, the connecting rod 373 of the stockings holder assembly 370 moves downwards, and the swing lever 372 lowers the holder plate 374 in order to press firmly the pair of stockings H" in the unit envelope P against the envelope conveyer 310. Thereafter, the insertion guide 320 and the inserter assembly 330 both resume their initial solid line positions in FIG. 13 while leaving the folded pair of stockings H" within the bag section Pb of the unit envelope P.

Next, the connecting rod 373 of the stockings holder assembly 370 moves upwards in order to release the hold on the pair of stockings H" by the holder plate 374 and, simultaneously, the flap holder assembly 350 releases its hold on the flap Pf by the pressor 353. Then, the envelope conveyer 310 circulates over a distance equal to the width of a unit envelope in order to place the next empty unit envelope P in registration with the enclosing station.

By periodically repeating the above-described series of operations, folded stockings H" for the stockings folder assembly are in sequence packed into successive unit envelopes P in the band of envelopes BP from the envelope feeder assembly.

In accordance with the present invention, a number of stockings are folded and packed into unit envelopes, either separately or combined, in a fully automatic manner. Operation of the insertion guide in keeping the open state of each unit envelope applies no destrictive tension to the unit envelope and insertion of folded stockings into the envelope by assistance of the inserter plate develops less creases on the folded stockings inserted into the unit envelope.

I claim:

1. Automatic stocking packing apparatus, comprising:

first means for intermittently feeding a band of stocking envelopes along a first direction from a point upstream of a stocking insertion position to a point downstream of said stocking insertion position such that each successive stocking envelope of said band is stationed at said stocking insertion position for a respective dwell period, the envelope located at said insertion position at any given instant being referred to as the active envelope, each said stocking envelope having a mouth which faces in a direction perpendicular to said first direction and through which stockings may be inserted into said envelope;

second means for opening said mouth of said active envelope located at said stocking insertion position;

a feeder plate extending in a second direction generally perpendicular to said first direction and having a smooth surface on which a pair of stockings or the like can smoothly slide;

third means for reciprocating said feeder plate along said second direction between a first position in which a front end of said feeder plate is located outside of said active envelope to a second position in which said front end of said feeder plate is located inside said active envelope during each said dwell period of said first means;

fourth means for placing a respective, folded pair of stockings or the like onto said smooth surface of said feeder plate during each said dwell period;

fifth means for pressing said folded pair of stockings located on said feeder plate against said smooth surface of said feeder plate including means for moving said pressing means in said second direction relative to said feeder plate and for sliding said pressed folded pair of stockings across said smooth surface and into said active envelope during each said dwell period by movement of said pressing means in said second direction relative to said feeder plate while said pressing means is pressing said folded pair of stockings against said smooth surface, the timing of fifth means being such that said pair of stockings or the like are not entirely inserted into said active envelope until said feeder plate is located in said second position; and sixth means for maintaining said folded pair of stockings or the like in said envelope while said feeder plate is being removed from said active envelope.

2. The apparatus of claiim 1, wherein said feeder plate is arcuate in cross section.

3. The apparatus of claim 1, wherein said sixth means comprises a holder plate for pressing down on said active envelope at a position remote from said front end of said feeder plate after said folded pair of stockings or the like has been fully inserted into said active envelope.

4. The apparatus of claim 1, wherein said fifth means includes an insertion plate movable between an upper position which is out of contact with said pair of stockings located on said smooth surface and a lower position which normally presses said pair of stockings against said smooth surface.

5. The apparatus of claim 4, wherein said insertion plate contacts said folded pair of stockings or the like at approximately the longitudinal center of said folded pair of stockings or the like as measured along said second direction.

6. The apparatus of claim 5, wherein said insertion plate is pivotable about an axis lying generally parallel to said first direction and pivots between a first position wherein it is out of contact with said folded pair of stockings or the like and a second position wherein it is in contact with said folded pair of stockings or the like.

7. The apparatus of claim 4, wherein said insertion plate moves along said second direction and relative to said feeder plate.

8. The apparatus of claim 7, wherein said insertion plate contacts a portion of said folded pair of stockings between upstream and downstream edges in said second direction and slides said folded pair of stockings or the like along said feeder plate by simultaneously pushing the portion of said folded pair of stockings which is downstream of said contacted portion and pulling the portion of said folded pair of stockings which is upstream of said contacted portion.

9. The apparatus of claim 1, wherein each said envelope is defined by an upper sheet and a lower sheet and wherein said second means comprises a suction device which contacts said upper sheet of said active envelope and pulls it away from said lower sheet of said active envelope so that said folded pair of stockings or the like can be inserted into said active envelope between said upper and lower sheets.

* * * * *